US005915613A

United States Patent [19]

Meschenmoser

[11] Patent Number: 5,915,613

[45] Date of Patent: Jun. 29, 1999

[54] SUCTION WEB TRANSFER DEVICE

[75] Inventor: Andreas Meschenmoser, Horgenzell, Germany

[73] Assignee: Voith Sulzer Papiermaschinen GmbH, Heidenheim, Germany

[21] Appl. No.: 08/758,523

[22] Filed: Nov. 29, 1996

[30] Foreign Application Priority Data

Dec. 1, 1995 [DE] Germany ..... 195 44 882

[51] Int. Cl.[6] ..... B65H 23/08; B65H 20/00

[52] U.S. Cl. ..... 226/95; 226/172

[58] Field of Search ..... 226/95, 171, 172

[56] References Cited

U.S. PATENT DOCUMENTS

| | | | |
|---|---|---|---|
| 4,336,813 | 6/1982 | Seragnoli | 226/95 |
| 4,481,066 | 11/1984 | Hirakawa et al. | 226/95 |
| 4,829,320 | 5/1989 | Une et al. | 226/172 |
| 4,984,728 | 1/1991 | Brinkmeier et al. | 226/172 |
| 5,267,431 | 12/1993 | Stahlecher et al. | 226/171 |
| 5,306,384 | 4/1994 | Statt | 226/95 |
| 5,518,490 | 5/1996 | Ziegelhoffer | 226/172 |
| 5,545,295 | 8/1996 | Fujita et al. | 162/358.1 |
| 5,564,174 | 10/1996 | Rovellini et al. | 226/172 |

FOREIGN PATENT DOCUMENTS 4116222 11/1992 Germany .

*Primary Examiner*—Charles A Marmor
*Assistant Examiner*—Matthew A. Kaness
*Attorney, Agent, or Firm*—Greenblum & Bernstein, P.L.C.

[57] ABSTRACT

A web transfer device for use in a machine for the production or processing of fibrous webs. The transfer device may include a transfer belt guided around a plurality of web guide rolls and positioned against a portion of a pick-up cylinder. The transfer device may also include a suction box for creating at least a partial vacuum between the web guide rolls to transfer the fibrous web from the pick-up cylinder to the transfer belt. The transfer device may also include a suction space having a peripheral surface including a portion of the transfer belt positioned adjacent to the pick-up cylinder and between the plurality of web guide rolls.

23 Claims, 3 Drawing Sheets

SUCTION WEB TRANSFER DEVICE

CROSS-REFERENCE TO RELATED APPLICATIONS

The present invention claims the priority under 35 U.S.C. § 119 of German Patent Application No. 195 44 882.0 filed on Dec. 1, 1995, the disclosure of which is expressly incorporated by reference herein in its entirety.

BACKGROUND OF THE INVENTION

1. Field of the Invention

The present invention relates to a web transfer device for a machine for the production of fibrous webs. The transfer device may include a transfer belt guided against a portion of a pick-up cylinder, a plurality of web guide rolls associated with the transfer belt, and a suction box. A suction space may be provided which may include a peripheral surface of the pick-up cylinder in contact with the transfer belt and may include the plurality of web guide rolls.

2. Discussion of the Background Information

Known web transfer devices utilized in the prior art may be generally shown in, e.g., DE 41 16 222 A1. These device have a transfer belt which rest against a pick-up cylinder and loops around part of it. The fibrous web to be transferred to the transfer belt in the transfer area runs across the pick-up cylinder. The transfer belt is guided by guide rolls and works together with a suction box. The suction box suctions the fibrous web through the transfer belt to support the transfer of the fibrous web to the transfer belt.

In the prior art device, the fibrous web can only be securely transferred if the suction box is brought very close to the transfer belt. Thus, the prior art device require a very precise adjustment of the distance between the suction box and the transfer belt. This precision adjustment generally requires costly construction and complicated control technology. Further, the prior art device may damage the fibrous web during the approach of the suction box toward the transfer belt if, e.g., bridging clots get into the slit between the suction box and a surface of the pick-up cylinder.

SUMMARY OF THE INVENTION

Accordingly, it is an object of the present invention to provide a web transfer device of simple construction and which overcomes the above-noted drawbacks of the prior art devices.

The present invention may be directed to a web transfer device that may include a transfer belt guided against a portion of a pick-up cylinder, a plurality of web guide rolls associated with the transfer belt, and a suction box. A suction space may be provided which may include a peripheral surface of the pick-up cylinder in contact with the transfer belt and may include the plurality of web guide rolls. Because the web transfer device of the present invention has a suction space in which a peripheral surface may be formed by the transfer belt section positioned between at least two guide rolls, there is a flexible, resilient bearing surface of the suction space abutting the pick-up cylinder. The flexible, resilient bearing surface prevents the occurrence of bridging clots in the fibrous web and their resulting damage, e.g., web breaks. The partial vacuum utilized in the suction space for the transfer of the fibrous web to the transfer belt may be built up with a suction box, even if the suction box is not arranged within close proximity to the pick-up cylinder. Thus, the suction box of the present invention, does not abut or touch the transfer belt at a position where infeed of bridging clots may occur. Because the web guide rolls may be located within the suction space, the present invention may be constructed in a very compact manner so that the web transfer device can be realized in a simple and cost effective manner.

In a preferred embodiment of the web transfer device, at least one web guide roll, e.g, the web guide roll on which the fibrous web picked up from the pick-up cylinder is running, may be constructed as a grooved or perforated guide roll. Because this embodiment of the present invention does not require suctioned guide rolls, the overall construction and design of the web transfer device may be simplified and more cost effective. Further, the partial vacuum utilized in the area of the web guide roll may be built up directly by the suction box present in the suction space. Thus, the partial vacuum source, working in combination with the suction box, may also be used by the grooved or perforated web guide roll.

According to another preferred feature of the present invention, the web transfer device may include an air block operating in combination with the transfer belt which acts upon air dragged (pulled) into the transfer area by the transfer belt. Thus, a power draw of the partial vacuum source coordinated within the suction space can be reduced, as the air present in the pick-up area is clearly reduced.

Accordingly, the present invention may be directed to a web transfer device for a machine producing fibrous webs. The web transfer device may include a transfer belt that partially loops around and abuts a cylinder, a plurality of web guide rolls associated with the transfer belt, and a suction box including a suction space having a peripheral surface formed by a portion of the transfer belt positioned between the plurality of web guide rolls. The suction box may form at least a partial vacuum in an area including the plurality of web guide rolls.

According to another feature of the present invention, the suction space may be defined by the suction box.

According to another feature of the present invention, the transfer belt running from one of the plurality of web guide rolls may be acted upon by the partial vacuum.

According to yet another feature of the present invention, at least one of the plurality of web guide rolls may include one of a grooved and perforated guide roll.

According to still another feature of the present invention, at least one of the suction box and the suction space may be subdivided in a plurality of partial vacuum sections arranged parallel to an axis of the cylinder.

According to a still further feature of the present invention, the transfer belt may run with the fibrous web across a transfer cylinder.

According to a further feature of the present invention, the machine may further include a transport belt associated with a subsequent area of the machine and a device for transferring the fibrous web from the transfer belt to the transport belt.

According to yet another feature of the present invention, the transfer belt may include a dryer screen associated with one of a drier group and a drier section.

According to still another feature of the present invention, at least one air block may act upon a boundary layer associated with the transfer belt.

According to a further feature of the present invention, the at least one air block may act upon a surface of the transfer belt abutting the cylinder.

According to another feature of the present invention, the at least one air block may include at least one of mechanical devices and air knives.

According to a still further feature of the present invention, the at least one air block may act upon a surface of the transfer belt facing the suction space.

According to yet another feature of the present invention, the suction box may include a lateral wall including a sealing system that maintains the partial vacuum.

In accordance with the present disclosure, the present invention may be directed to a web transfer device for use in one of a web producing and web processing machine having a press cylinder. The web transfer device may include at least two web guide rolls, a transfer belt, guided around the at least two web guide rolls, that forms a transfer section between the at least two web guide rolls, the transfer section to be abuttingly placed adjacent the press cylinder. The device may also include a suction space including the transfer section and the at least two web guide rolls, and a suction box positioned adjacent the suction space and opposite the transfer section.

According to a further feature of the present invention, the device may further include at least one air block device for blocking an air boundary layer associated with the transfer belt.

According to yet another feature of the present invention, the air boundary layer may be associated with a surface of the transfer belt facing the web transfer device, and the at least one air block device may include at least one of a mechanical device and an air knife.

According to yet another feature of the present invention, the air boundary layer may be associated with a surface of the transfer belt opposite the web transfer device, and the at least one air block device may include an oppositely moving belt.

According to still another feature of the present invention, the device may further include at least one lateral wall for defining the suction space, and the at least two web guide rolls may protrude through the at least one lateral wall.

According to yet another feature of the present invention, the at least one lateral wall may include a sealing member positioned adjacent to each of the at least two web guide rolls.

According to a still further feature of the present invention, the at least one lateral wall may include an opening associated with each of the plurality of web guide rolls, each opening sufficient to receive at least an end portion of a respective web guide roll. Each opening may position the sealing member, including a felt strip, adjacent the respective web guide roll.

According to still another feature of the present invention, the at least one lateral wall may include a release opening including a spoiler device and a recoil body mounted for relative movement, and the release opening may release a medium under pressure to create a partial vacuum between the plurality of web guide rolls.

According to a still further feature of the present invention, the medium under pressure may include blast air.

According to yet another feature of the present invention, the release opening may release the medium under pressure from within the suctions space to outside the suction space.

Additional features of the present invention and various alternatives to the preferred embodiment are disclosed for the ordinarily skilled artisan to practice the various features of the present invention, without departing from the spirit of the same.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The web transfer device described herein may be installed anywhere within a machine producing a fibrous web, e.g., of paper or cardboard, in which the fibrous web is to be transferred from a cylinder to a downstream processing unit. However, it may be preferred to position the web transfer device of the present invention within a transfer area between a press section and a drier section. This positioning of the web transfer device may ensure safe transfers of the fibrous web to a transfer belt.

Figure 1:
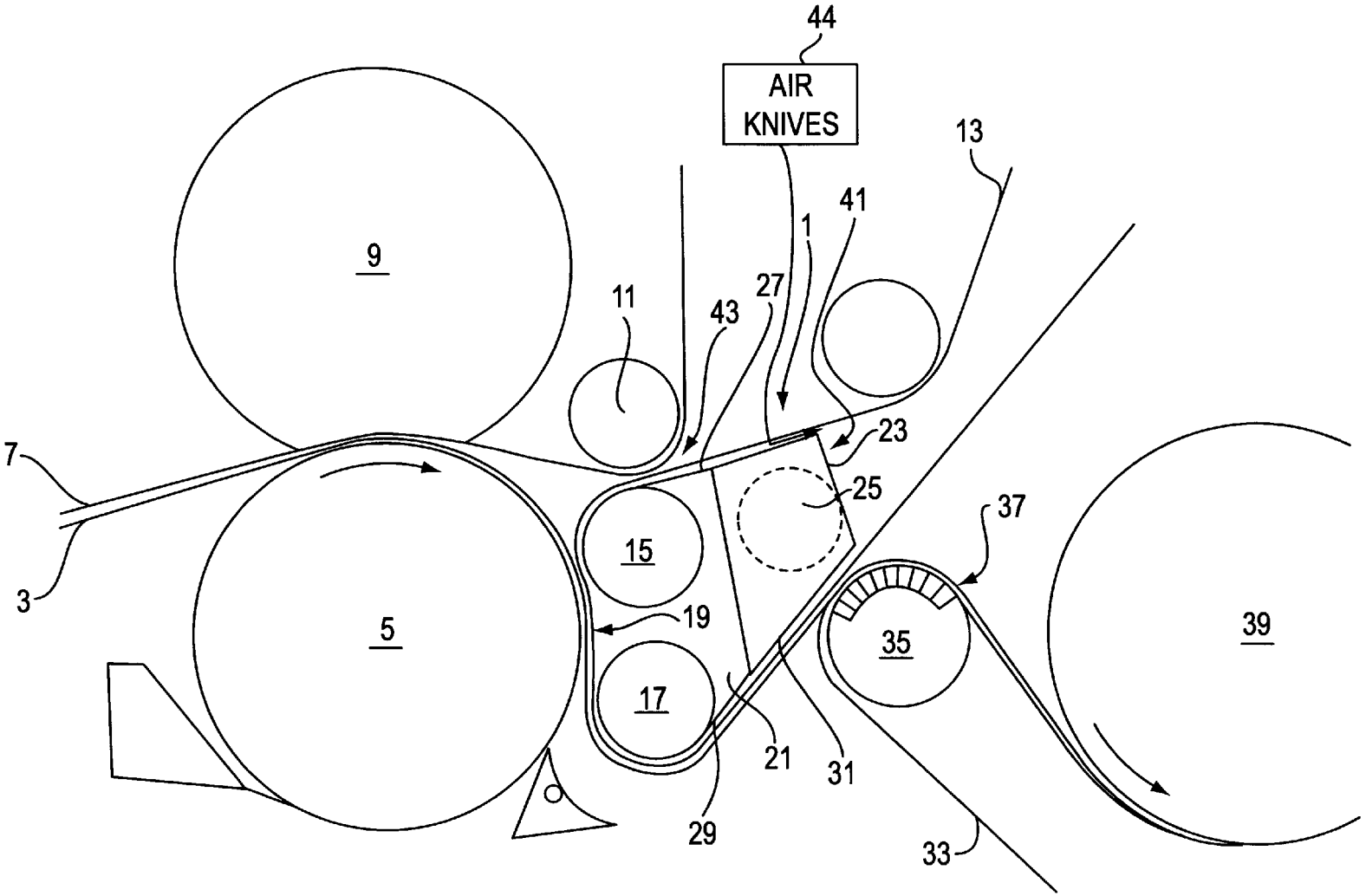
FIG. 1 illustrates a first embodiment of a web transfer device according to the present invention.

FIG. 1 shows, for example, a web transfer device 1 for transferring a fibrous continuous web 3 from a pick-up cylinder, e.g., a press cylinder 5 to a subsequent portion of the web producing machine, e.g., a drier section. Fibrous web 3 may be guided, via a transport belt or a wet felt 7, through a roll nip formed by press cylinder 5 and a linked second press cylinder 9. Fibrous web 3 emerging from the roll nip may adhere to the surface of the press cylinder 5, thus, transferring fibrous web 3 to press cylinder 5 before entering transfer device 1. Transport belt 7 emerging from the roll nip may be guided across a first web guide roll 11 and, if necessary, may be guided back to a beginning portion of the press section.

Web transfer device 1 may include a transfer belt 13, which is made of an air permeable material, guided over at least two web guide rolls 15 and 17. A portion of transfer belt 13 positioned between web guide rolls 15 and 17 lie adjacent to a portion of a circumference of pick-up (or press) cylinder 5. In a first embodiment depicted in FIG. 1, web guide rolls 15 and 17 are positioned so as not to press the transfer belt 13 against the pick-up cylinder 5. In addition, in a second embodiment depicted in FIG. 2, distance should be maintained between the transfer belt 13, when divided over each web guide roll 15 and 17, and the pick-up cylinder 5. The portion of transfer belt 13 that lies adjacent the circumference of press cylinder 5 forms a transfer section 19. The transfer section may receive a portion of fibrous web 3 and may concurrently press fibrous web 3 between the portion of the circumference press cylinder 5 and the portion of the transfer belt positioned between guide rolls 15 and 17.

Transfer section 19, i.e., between the web guide rolls 15 and 17, may form a peripheral surface of a suction area 21.

Suction area 21 may include a suction box 23 with a suitable partial vacuum source 25. Suction box 23 may form a peripheral surface of the suction space 21 located opposite transfer section 19. Suction box 23 may open toward suction space 21 to create a partial vacuum that acts upon transfer section 19, and, therefore, acts upon fibrous web 3 abutting press cylinder 5.

Web transfer device 1 may also include wall sections 27 and 29 that extend from the suction box 23 to web guide rolls 15 and 17. Ends of each of wall sections 27 and 29 may sealingly abut an outer surface of web guide rolls 15 and 17, respectively to maintain suction space 21. Wall section 29, which may be associated with web guide roll 17 or, more specifically, with the portion of transfer belt 13 leaving transfer section 19, may be, e.g., an air permeable material. A lateral peripheral wall 31 of suction space 21 may also be comprised of an air permeable material and may be coordinated with web guide roll 17. Thus, the present invention ensures a particularly safe transfer of fibrous web 3 via suction.

Web transfer device 1 may also include transfer wall section 47 (and a corresponding lateral wall section (not shown) positioned on an opposite side of suction space 21). Lateral wall section 47 may be substantially perpendicular to the axes of rotation of web guide rolls 15 and 17 and may sealingly receive each of web guide rolls 15 and 17 which produce a seal of the suction space 21. That is, at least a portion of each end of web guide rolls 15 and 17 may extend out of suction space 21 through sealed sections of lateral wall section 47.

The removal of fibrous web 3 from press cylinder 5 for transfer to transfer belt 13 may be assisted by web guide roll 17, which may be, e.g., a grooved or perforated guide roll. Fibrous web 3, when guided over web guide roll 17, may be suctioned by the partial vacuum built up in suction space 21 and may be securely held on transfer belt 13. By securely holding fibrous web 3 to transfer belt 13, web flutter and inadvertent breaking the fibrous web 3 may be reduced. Further, the present invention does not require any additional partial vacuum devices for suctioning web guide roll 17. In other words, the partial vacuum created by suction box 23 acts on the fibrous web 3 through suction space 21 and through web guide roll 17. Accordingly, the present invention may provide a web transfer device that may be realized in a very compact and cost efficient manner with a low susceptibility to failure.

Fibrous web 3 may be transferred from web transfer device 1 to a subsequent area of the machine for the production of a fibrous web, e.g., to a drier section. For example, after fibrous web 3 has been transferred to transfer belt 13, transfer belt 13 may be guided past a web guide roll 35 that includes a transport belt. Web guide roll 35 may be, e.g., a suctioned roll. As transfer belt 13, transport belt 33 and fibrous web 3 meet at web guide roll 35, e.g., at a beginning of a transfer area 37, suctioning by web guide roll 35 transfers fibrous web 3 from transfer belt 13 to transport belt 33. Preferably, the suctioning in web guide roll 35 occurs within transfer area 37. Fibrous web 3 and transport belt 33 may then be guided to a first cylinder 39 of the subsequent area of the production machine, e.g., a first drier cylinder.

Transfer belt 13 may be guided from web guide roll 35 to return to suction space 21 or to press cylinder 5 in any suitable manner.

In order to reduce the amount of air pulled along by the transfer belt 13, suitable air blocks may be provided to act on an inner surface of transfer belt 13, i.e., a surface facing suction space 21, and on an outer surface of transfer belt 13, i.e., a surface not facing suction space 21. To remove the air boundary layer from the inner surface of transfer belt 13, a first air block 41 may be constructed in a mechanical manner and may include a scraper device which lifts an air boundary layer from transfer belt 13. In addition to, or in lieu of, the mechanical scraper device for lifting the air boundary layer, air block 41 may include air knives 44 (as depicted by the "black box" in FIG. 1) that remove or peel off the air boundary layer by directing air currents or blasts opposite the air boundary layer.

To remove the air boundary layer from the outer surface of transfer belt 13, a second air block may be provided, e.g., similar to the mechanical device discussed above. However, as an alternative to the mechanical device, an air block 43 may be realized in the present invention by wet felt 7 being guided around web guide roll 11 and guided very close to, but in an opposite direction of transfer belt 13. Thus, a small slit may be formed between the two belts running in opposite direction results. By the above arrangement, the air boundary layer running along the outer surface of transfer belt 13 may be removed by the outgoing section of wet felt 7. The first and second air blocks may reduce the amount of air introduced into a nip formed between transfer belt 13 and the surface of the press cylinder 5 in the transfer section 19. Therefore, the suction generated by suction box 23 may be relatively low, and the energy expenditure necessary to successfully transfer fibrous web 3 in web transfer device 1 may remain relatively low.

Figure 2:
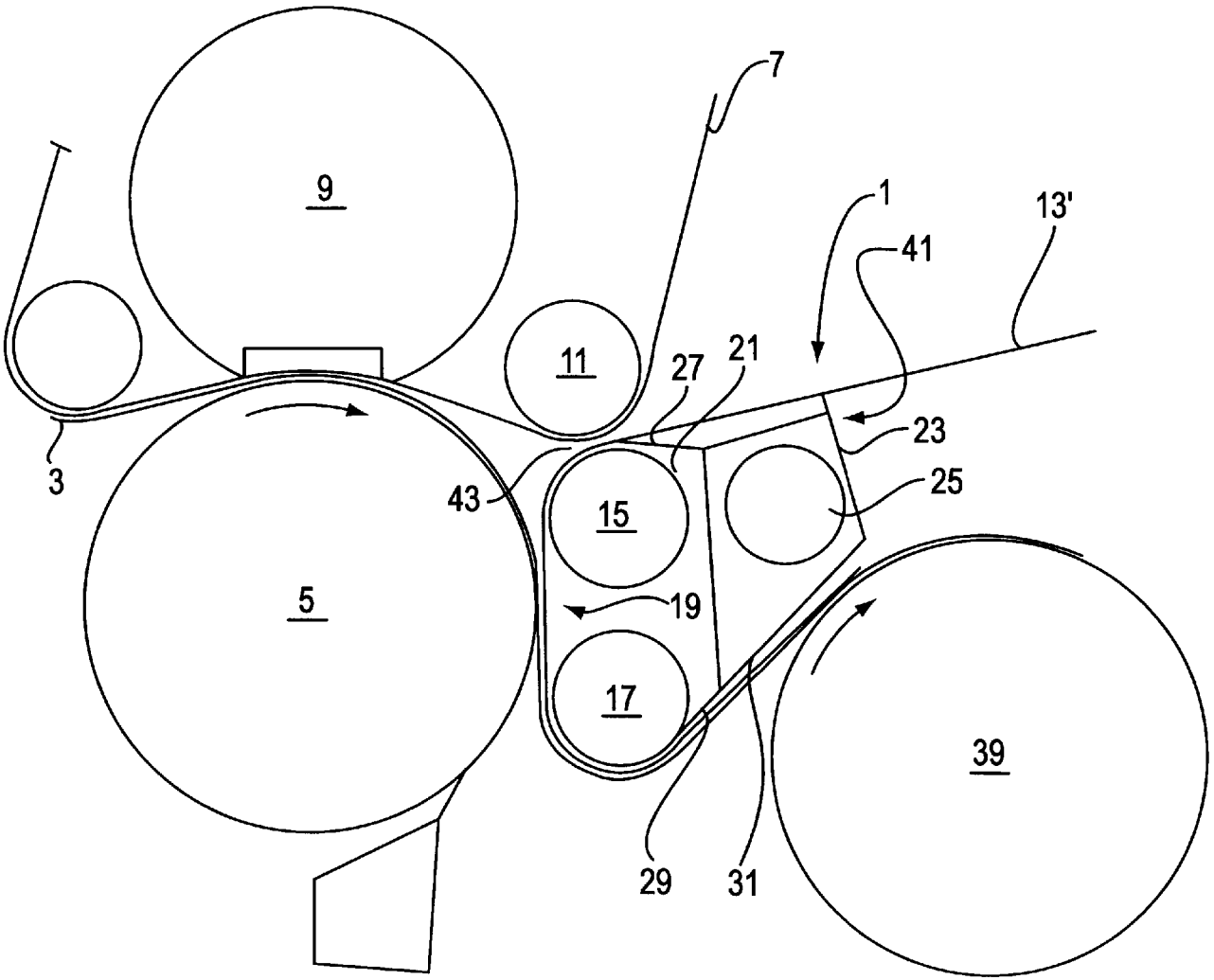
FIG. 2 illustrates a second embodiment of a web transfer device according to the present invention.

FIG. 2 illustrates a second embodiment of web transfer device 1 that, likewise, may lift fibrous web 3 from a cylinder 5, e.g., a press cylinder. Web transfer device 1, according to the second embodiment may guide the transferred fibrous web 3 to a cylinder in a subsequent area of the paper production machine, e.g., a first cylinder 39 of a drier system. It is noted that parts designated in FIG. 2 that are similar to those shown above in Figure will be designated by the same reference numbers.

The web transfer device 1 of FIG. 2, in contrast to that of FIG. 1, utilizes only two belt members. That is, a transfer belt 13' may be utilized to receive the transferred fibrous web 3 from press cylinder 5 and to guide fibrous web 3 through at least first cylinder 39 of the drier section. Because transfer belt 13' is made of an air permeable material and is utilized to guide the fibrous web 3 into the drier section, the second embodiment does not require a transport belt or a suctioned transfer roll, as utilized in FIG. 1. Web transfer device 1 may, therefore, be constructed in a simple and more compact manner than even the embodiment depicted in FIG. 1. Web guide roll 11, with wet felt 7 guided around at least a portion of its circumference, may be positioned at a distance from web guide roll 15 and, therefore, from transfer belt 13' greater than that utilized in the first embodiment. However, the distance between the guide rolls 11 and 15 may be reduced so as to reduce the amount of air pulled into transfer section 19 by the transfer belt 13'. Alternatively, the air boundary layer may be removed by the movement of wet felt 7 in the direction opposite the transport direction of transfer belt 13'.

Transfer belt 13' may be guided through the direr group following first cylinder 39. Thus, transfer belt 13' may also be utilized as a drying screen of this group or drier section. Because transfer belt 13' may act as a drying screen, the second embodiment does not require a separate transfer belt for guiding the fibrous web 3 through the drier section.

To ensure a lateral seal of suction space 21, lateral peripheral walls 47 may be provided which sealing abut web guide rolls 15 and 17 and form the lateral sides of suction space 21.

Figure 3:
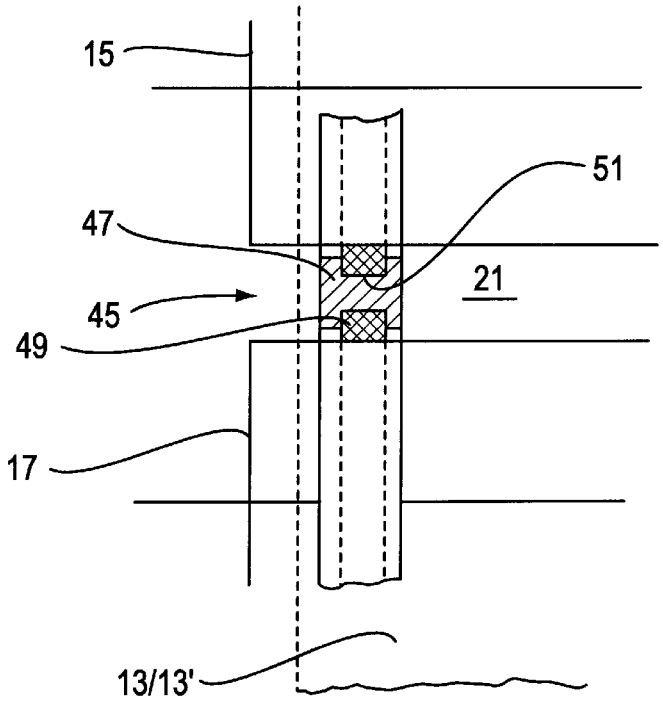
FIG. 3 illustrates an alternative lateral seal for the web guide rolls of the web transfer device.

FIG. 3 illustrates a first sealing system 45 for sealingly engaging lateral peripheral walls 47 of suction space 21 and the outer surface of web guide rollers 15 and 17. In FIG. 3, a longitudinal view of web guide rolls 15 and 17 is shown. Transport belt 13 or 13' is illustrated in by a broken line that traverses each of web guide rolls 15 and 17. Sealing system 45 may include felt strips 49 inserted into lateral peripheral wall 47 of suction space 21. Alternatively, felt strips 49 may be substituted with any suitable material, e.g., brush strips or other similar mechanical sealing systems. Felt strips 49 may be inserted into suitable grooves 51 in lateral peripheral wall 47 and may rotate either with respect to grooves 51 or with respect to web guide rolls 15 or 17. For example, grooves 51 may be inserted into a surface of a front face of the lateral wall 47, i.e., facing the surface of the guide rolls 15 and 17. Lateral peripheral walls 47 may be attached to suction box 23 in any desired manner, e.g., by screws, etc. Wall guide rolls 15 and 17 may penetrate the lateral peripheral wall 47 and may be sealed by felt strips 49 of sealing system 45 so as to build up a partial vacuum in suction space 21 with little loss.

Figure 4:
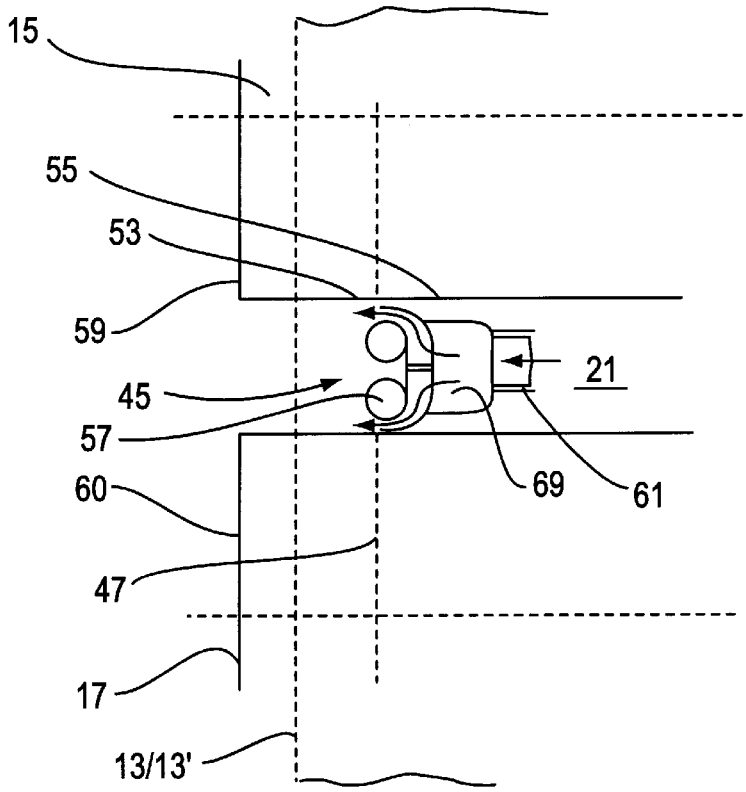
FIG. 4 illustrates another alternative lateral seal for the web guide rolls of the web transfer device.

FIG. 4 illustrates a second contemplated sealing system according to the present invention. In FIG. 4, suction space 21 or suction box 23 may be sealed to build up a partial vacuum with little loss. The element designated in FIG. 3 which have already been described will have the same reference number designation in FIG. 4.

FIG. 4 shows a touchless (non-contacting) sealing system 45' provided between guide rolls 15 and 17. The touchless sealing system 45' may affect a transition area located between lateral peripheral wall 47 and the surface of guide rolls 15 and 17.

Sealing system 45' may include an air release opening 53 operating in conjunction with the portions of guide rolls 15 and 17 extending through lateral peripheral wall 47. Sealing system 45' may also include a spoiler 55, arranged at a distance from the guide rolls 15 and 17, and a recoil body 57. From air release opening 53, a predetermined medium under pressure, e.g., blast air, may be released. The blast air may flow out of air release opening 53 along the outer surface of guide rolls 15 and 17 to the facing ends 59 and 60 of guide rolls 15 and 17. Thus, sealing system 45' creates a suctioned slit having a partial vacuum in the slit formed within suction space 21 by spoiler 55 and the outer surfaces of guide rolls 15 and 17. The blast air may be guided through a distribution space 69 in connection with air release opening 53. Blast air may be introduced into distribution space 69 in any suitable manner, e.g., an inlet opening 61.

Thus, touchless sealing system 45' operates in a similar manner to an air knife while ensuring that, even with a partial vacuum in the suction space, no air can penetrate suction space 21 from outside touchless sealing system 45'. Touchless sealing system 45', may be particularly resistant to wear and tear because there is no possible contact between the fixed sealing system 45' and the rotating guide rolls 15 and 17.

Sealing systems 45 and 45' may be characterized by a particularly simple construction which effectively prevents a pressure loss in the suction space 21 and can be realized in a cost effective manner.

In accordance with the present invention, suction space 21 may include a flexible peripheral wall formed by transfer belt 13 (13') within transfer section 19. The pressure acting on the pick-up cylinder or press cylinder 5 within the transfer section 19 may be adjusted by tightening transfer belt 13 (13') without necessitating resetting of web guide rolls 15 and 17 and/or resetting suction box 23. Thus, web transfer device 1 may be realized in a simple and cost effective manner without reducing the functional safety in any manner. Further, contrary to the prior art devices, bridging clots that may be carried along by fibrous web 3 may be cushioned by the resilient peripheral wall of suction space 21, i.e., transfer belt 13 (13') within transfer section 19. Thus, the surface quality of fibrous web 3 may be greatly improved while the propensity for web breaks may be greatly reduced.

Because fibrous web 3 is held against transfer belt 13 (13') due to the partial vacuum through web guide roll 17, and because the portion of the web producing machine following web guide roller 17 may be suctioned up to deliver fibrous web 3 to the transport belt 33, or, alternatively, to first cylinder 39, secure guidance of fibrous web 3 in the vicinity of the web transfer device is ensured.

In accordance with the embodiment shown in FIG. 1, the running speed of transfer belt 13 may be adjusted to the rotational speed of press cylinder 5 to as to exert a predefined tensile force on fibrous web 3. This tensile force may expedite the transfer of fibrous web 3 from the portion of the circumferential surface of press cylinder 5 to the subsequent treatment device, e.g., a drier section, through transfer belt 13. Further, it is also possible to influence the shrinkage characteristics of fibrous web 3.

The embodiment according to FIG. 1 is distinguishable from the embodiment in FIG. 2 because a predefined difference in speed may be prescribed for transferring fibrous web 3 from transfer belt 13 to transport belt 33 and for exerting lengthwise tensile forces on fibrous web 3. The speed difference between press cylinder 5, transfer belt 13 and transport belt 33 may be adjusted for different operating conditions e.g., material properties of the web.

In the embodiment shown in FIG. 2, a speed difference may be adjusted for transferring the fibrous web 3 from press cylinder 5 to transfer belt 13' and for transferring fibrous web 3 from transfer belt 13' to first cylinder 39 of the drier section.

In view of the foregoing, the web transfer device according to the present invention may be applied, not only between a press section and a drier section, but everywhere within the machine for the production of a fibrous web, e.g., paper, cardboard or similar material. The present invention may also be advantageous within an area of group separations, e.g, within the drier section, and may also be advantageous for transferring a fibrous web from the drier section to secondary treatment stations.

Further, suction space 21 may be subdivided into a plurality of sections parallel to the axes of web guide rolls 15 and 17 to define sections in which various partial vacuums may be exhibited. In the subdivided section closest to the transfer section, the partial vacuum should be sufficient to the transfer of a threading strip, i.e., provide sufficient suctioning to the transfer belt within the transfer section when the threading strip is running therethrough. The remaining subdivided sections of suction box 23 may exhibit a distinctly lower partial vacuum or atmospheric pressure. Thus, it is possible to save energy for creating a partial vacuum during threading. Further, as shown in FIGS. 3 and 4, suction box 23 may be closed at its front ends to reduce the in-flow of outside air to a minimum and to restrict the suction effect of the suction box to the areas delineated by transfer section 19, perforated or grooved web guide roll 17, and the area after the web guide roll 17.

To ensure a defined run of transfer belt 13 (13') through transfer section 19, a section of transfer belt 13 (13') located before web guide roll 15 may also be suctioned by suction space 21. Further, web guide roll 15 may alternatively be, e.g., a perforated or grooved guide roll. By providing web guide roll as a suction roll, any air boundary layer pulled along by the transfer belt which was not held back or diverted by the air blocks may be suctioned off. Thus, the transfer belt may adhere particularly well to fibrous web 3 as it abuts pick-up cylinder or press cylinder 5, ensuring a secure transfer or web pick-up.

The tension of transfer belt 13 (13') guided around web guide rolls 15 and 17 may be acted upon with a force almost sufficient to pull guide rolls 15 and 17 off of the surface of press cylinder 5. Because of these high tensile forces, there is a constant threat that web guide rolls, particularly those with relatively small diameters, may bend. Because of this constant threat, the machine may not always be able to ensure optimal adhesion of the transfer belt to the surface of the press cylinder 5 within transfer section 19. To prevent bending, a support (not shown) for web guide rolls 15 and/or 17 may be provided. However, it is within the purview of the ordinarily skilled artisan to realize, e.g., a hydraulic support within the guide roll to properly support the web guide rolls and prevent them from bending. Further, the present invention contemplates additional support rollers (not shown) positioned on the side of web guide rolls 15 and/or 17 which do not face press cylinder 5. These additional support rollers may be supported from within the suction space to prevent bending, e.g., by hydraulic support.

Web guide rolls 15 and 17 and/or support rolls arranged behind them, may be, e.g., carbon fiber reinforced rolls. With such rolls, the tensile forces exerted by the transport belt may be flattened out and bending may be prevented.

It is noted that the foregoing examples have been provided merely for the purpose of explanation and are in no way to be construed as limiting of the present invention. While the invention has been described with reference to a preferred embodiment, it is understood that the word which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A web transfer device for a machine producing fibrous webs comprising:

a transfer belt that partially loops around and abuts a cylinder;

a plurality of web guide rolls associated with the transfer belt; and a suction box including a suction space having a partial peripheral surface formed by a portion of the transfer belt positioned between the plurality of web guide rolls;

the suction box forming at least a partial vacuum in an area including the plurality of web guide rolls.

2. The web transfer device according to claim 1, the suction space being defined by the suction box and said portion of said transfer belt.

3. The web transfer device according to claim 1, the transfer belt runs from one of the plurality of web guide rolls and is acted upon by the partial vacuum.

4. The web transfer device according to claim 1, at least one of the plurality of web guide rolls comprising one of a grooved and perforated guide roll.

5. The web transfer device according to claim 1, at least one of the suction box and the suction space being subdivided in a plurality of partial vacuum sections arranged parallel to an axis of the cylinder.

6. The web transfer device according to claim 1, the transfer belt running with a fibrous web across a transfer cylinder.

7. The web transfer device according to claim 1, in combination with a transport belt associated with a subsequent area of the machine and a device for transferring the fibrous web from the transfer belt to the transport belt.

8. The web transfer according to claim 1, the transfer belt comprising a dryer screen associated with one of a dryer group and a dryer section.

9. The web transfer device according to claim 1, at least one air block that acts upon a boundary layer associated with the transfer belt.

10. The web transfer device according to claim 9, the at least one air block acting upon a surface of the transfer belt abutting the cylinder.

11. The web transfer device according to claim 9, the at least one air block comprising at least one of mechanical devices and air knives.

12. The web transfer device according to claim 9, the at least one air block acting upon a surface of the transfer belt facing the suction space.

13. The web transfer device according to claim 1, the suction box comprising a lateral wall including a sealing system that maintains the partial vacuum.

14. A web transfer device for use in one of a web producing and web processing machine having a press cylinder, said web transfer device comprising:

at least two web guide rolls;

a transfer belt, guided around said at least two web guide rolls, forming a transfer section between said at least two web guide rolls, said transfer section to be abuttingly placed adjacent the press cylinder;

a suction space comprising said transfer section and said at least two web guide rolls; and a suction box positioned adjacent said suction space and opposite said transfer section.

15. The web transfer device according to claim 14, further comprising at least one air block device for blocking an air boundary layer associated with said transfer belt.

16. The web transfer device according to claim 15, said air boundary layer associated with a surface of said transfer belt facing said web transfer device, and said at least one air block device comprising at least one of a mechanical device and an air knife.

17. The web transfer device according to claim 15, said air boundary layer associated with a surface of said transfer belt opposite said web transfer device, and said at least one air block device comprising an oppositely moving belt.

18. The web transfer device according to claim 14, further comprising at least one lateral wall for defining said suction space, and said at least two web guide rolls protruding through said at least one lateral wall.

19. The web transfer device according to claim 18, said at least one lateral wall comprising a sealing member positioned adjacent to each of said at least two web guide rolls.

20. The web transfer device according to claim 19, said at least one lateral wall comprising an opening associated with each of the plurality of web guide rolls, each opening sufficient to receive at least an end portion of a respective web guide roll, each said opening for positioning said sealing member, comprising a felt strip, adjacent said respective web guide roll.

21. The web transfer device according to claim 19, said at least one lateral wall comprising a release opening including a spoiler device and a recoil body mounted for relative movement, and said release opening releasing a medium under pressure to create a partial vacuum between said plurality of web guide rolls.

22. The web transfer device according to claim 21, said medium under pressure comprising blast air.

23. The web transfer device according to claim 21, said release opening releasing the medium under pressure from within said suction space to outside said suction space.

* * * * *